United States Patent [19]

Mills

[11] Patent Number: 5,052,251

[45] Date of Patent: Oct. 1, 1991

[54] LOCKING WRENCHES

[75] Inventor: J. David Mills, Mobile, Ala.

[73] Assignee: Blue Water Holding Company, Inc., Dauphin Island, Ala.

[21] Appl. No.: 583,977

[22] Filed: Sep. 18, 1990

Related U.S. Application Data

[63] Continuation-in-part of Ser. No. 571,202, Aug. 23, 1990, abandoned.

[51] Int. Cl.[5] ..... B25B 7/14; B25B 7/12

[52] U.S. Cl. ..... 81/324; 81/327; 81/328; 81/367; 81/380; 81/427.5

[58] Field of Search ..... 81/318–328, 81/367–384, 427.5; 7/125; 269/3, 6; 70/200, 18, 237, 61

[56] References Cited

U.S. PATENT DOCUMENTS

| | | | |
|---|---|---|---|
| 527,592 | 10/1894 | Cochran . | |
| 776,598 | 12/1904 | Kettelsen . | |
| 1,163,428 | 12/1915 | McMillen . | |
| 1,274,427 | 8/1918 | Landmann . | |
| 1,313,687 | 8/1919 | Hellweg . | |
| 1,316,407 | 9/1919 | Auperl . | |
| 1,377,413 | 5/1921 | Dwelle . | |
| 1,392,194 | 9/1921 | Mills . | |
| 1,398,122 | 11/1921 | Bender . | |
| 1,489,458 | 4/1924 | Petersen | 81/380 |
| 1,582,498 | 4/1926 | Wilkerson . | |
| 1,586,513 | 6/1926 | Anderson . | |
| 1,640,883 | 8/1927 | Coleman . | |
| 2,280,005 | 4/1942 | Petersen | 81/84 |
| 2,409,627 | 10/1946 | Helgeson . | |
| 2,482,193 | 9/1949 | Malmquist | 81/78 |
| 2,514,130 | 7/1950 | Jones | 81/84 |
| 2,592,807 | 4/1952 | Jones | 81/84 |
| 2,606,466 | 8/1952 | Wright | 81/5.1 |
| 2,612,808 | 10/1952 | Small | 81/81 |
| 4,229,924 | 10/1980 | Teachout, Sr. | 53/399 |
| 4,462,284 | 7/1984 | Gowers | 81/248 |
| 4,889,021 | 12/1989 | Morrison | 81/325 |
| 4,893,530 | 1/1990 | Warheit | 81/409.5 |
| 4,912,949 | 4/1990 | Bowers . | |

FOREIGN PATENT DOCUMENTS

| | | | |
|---|---|---|---|
| 686 | of 1890 | United Kingdom | 81/327 |

*Primary Examiner*—D. S. Meislin

*Attorney, Agent, or Firm*—Nixon & Vanderhye

[57] ABSTRACT

Improved locking wrenches are provided with adjustment screws having a head portion which defines at least one opening registerable with an aperture defined in an extension member rearwardly extending from the lower handle of the wrench. In this manner, a restraining element may be placed through the registered opening/aperture to positionally restrain (immobilize) the upper and lower wrench handles relative to one another. The head of the adjustment screw and/or the extension member according to the present invention may be embodied in a number of alternative arrangements to provide the necessary cooperative relationship as between the opening and aperture respectively defined thereby.

43 Claims, 3 Drawing Sheets

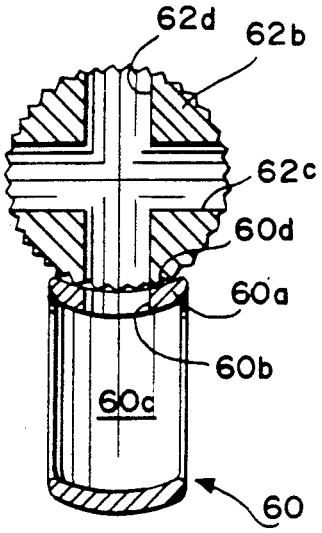
FIG. 6
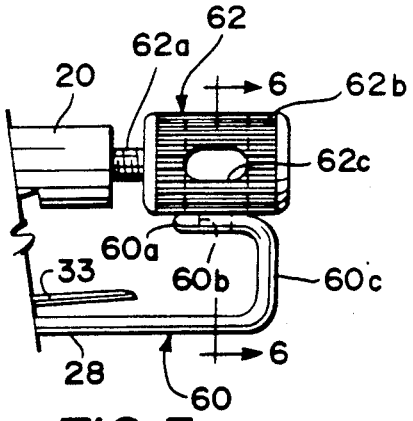
FIG. 5
FIG. 7
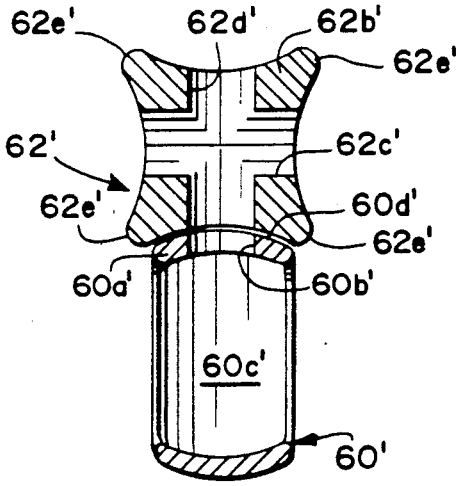
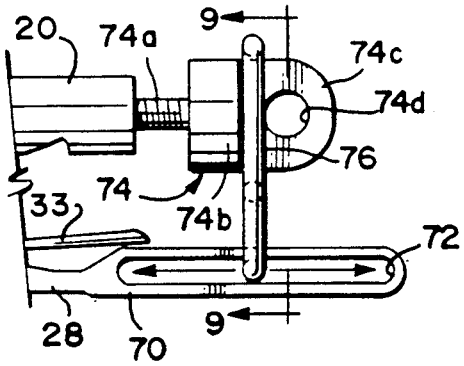
FIG. 8
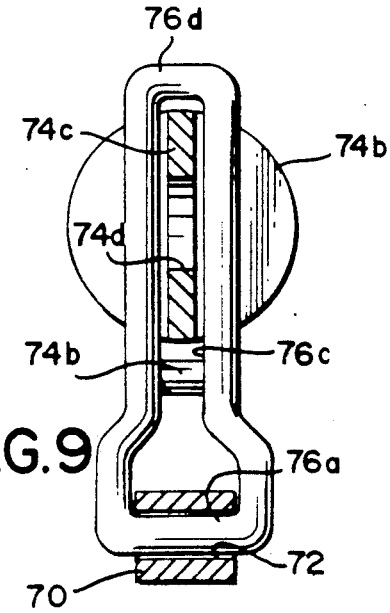
FIG. 9

LOCKING WRENCHES

CROSS-REFERENCE TO RELATED APPLICATIONS

This application is a continuation-in-part of copending U.S. application Ser. No. 07/571,202 filed on Aug. 23, 1990, entitled "Improvements to Locking Wrenches" (now abandoned), the entire content of which is expressly incorporated hereinto by reference.

FIELD OF THE INVENTION

The present invention generally relates to locking-type wrenches. More specifically, the present invention relates to locking-type wrenches which are especially adapted such that the operating handles may be positionally restrained.

BACKGROUND AND SUMMARY OF THE INVENTION

Locking wrenches are well known tools that are employed in situations where it is desirable to clamp one structural member to another so that the operator's hands may be freed to accomplish other tasks. Examples of conventional locking wrenches include those wrenches disclosed in prior-issued U.S. Pat. No. 2,280,005 issued to William Peterson on Apr. 14, 1942; U.S. Pat. No. 2,514,130 issued to Harold T. Jones on July 4, 1950; and U.S. Pat. No. 2,592,807 issued to Harold T. Jones on Apr. 15, 1952 (the entire content of each of these prior-issued U.S. Patents being expressly incorporated hereinto by reference).

Conventional locking wrenches are generally comprised of an upper handle having a fixed-position upper jaw at its forward end and a threaded sleeve at its rearward end. A pivotally movable lower jaw is disposed in opposition to the upper jaw and is moved towards and away from the upper jaw by means of a lower operating handle (which is itself pivotally connected to the lower jaw). A toggle lever is pivotally connected at one end to the lower operating handle, and is slidably received within the upper handle at its opposite end. Typically, a tension spring biases the lower jaw in a pivotal direction tending to separate it from the upper jaw. An adjustment screw is threadably coupled within the sleeve of the upper handle and has a terminal end that acts upon the opposite end of the toggle lever.

As those in the art will appreciate, due to the relative connections between the toggle lever, lower operating handle, and lower jaw, turning movements applied to the adjustment screw will responsively cause the lower jaw to be moved pivotally relative to the fixed upper jaw. In this manner, the clamping force that is exerted by the upper and lower jaws may be selectively adjusted by the operator. In addition, the toggle lever increases the clamping force that is applied to structural members held between the upper and lower jaws when the lower operating handle is forcibly moved into a closed condition relative to the upper handle.

While conventional clamping wrenches function to clamp structural members securely one to another, there is a risk that the clamping force may suddenly be released—e.g., as might occur should the wrench and/or structural members held by the wrench be struck by an object with sufficient force to cause the lower operating handle to be moved under the influence of the tension spring to an opened condition relative to the upper handle. Sudden release of the clamping force may, in turn, release the structural members that had just moments before been securely clamped and allow them to strike the operator and/or others in the vicinity of the work area thereby causing potentially serious injuries.

One prior proposal for positionally restraining the upper and lower handles of a locking wrench is represented by U.S. Pat. No. 4,889,021 issued to Joseph L. to Morrison on Dec. 26, 1989. According to Morrison '021, the upper and lower handles of a locking wrench are provided with vertically aligned apertures so as to accommodate upper and lower stubs associated with an especially adapted padlock. The upper stub moreover bears against a brake means located physically within the upper handle member so as to apply braking force against the adjustment screw thereby inhibiting its turning movements.

While the locking wrench proposal in Morrison '021 appears to function in a manner that would minimize the risk of sudden release of the clamping force, it necessarily requires a separate and especially adapted padlock to always be available to the operator.

What has been needed therefore are improvements to conventional locking-type wrenches which would significantly reduce (if not eliminate entirely) the risks associated with the inadvertent sudden release of a wrench's clamping force and which would not require especially adapted restraining elements. Thus, locking-type wrenches that are inherently safer and more convenient to use have been needed. It is towards fulfilling such needs that the present invention is directed.

According to the present invention novel locking-type wrenches are provided such that the upper and lower handles are positionally restrained or immobilized relative to one another. More specifically, preferred embodiments of the present invention include a rearwardly directed extension member that defines an aperture associated with the lower operating handle, and means associated with the adjustment screw to coact with the aperture in the lower handle flange extension so as to positionally restrain the upper and lower handles relative to one another.

According to some preferred embodiments of the present invention, the head of the adjustment screw includes pairs of radially extending wings each of which defines an opening. The extension member is rigid with the lower operating handle and is located at a position such that it may be brought into an adjacent position with one of the wings when the lower operating handle is in a closed condition relative to the upper handle. Thus, when the extension member is adjacently positioned relative to one of the wings (i.e., when the lower operating handle is in a closed condition), the respective opening defined in that one wing and the aperture defined in the extension member will be in alignment. In such a manner, a restraining element (which could be virtually any suitable rigid or flexible member, such as a bolt, pin, rod, tube, padlock hasp, wire, rope, or the like) may be passed through the aligned opening/aperture to thereby positionally restrain the upper and lower handle members relative to one another. The risk of inadvertent sudden release of the clamping force is thereby minimized (if not eliminated).

Other embodiments of the invention include apertured adjustment screw heads of selected geometrical configuration, and an opening defined in the extension member. The extension member according to these alternative embodiments will likewise be oriented so that it is adjacent to the apertured adjustment screw head when the lower operating handle member is in its closed condition so that at least one of its defined apertures will be in alignment with an opening formed in the extension member.

The extension member may include a movable restraining element that defines an opening. The restraining element may be pivoted, for example, so that its defined opening is brought into operative association with a key flange associated with the adjustment screw head so as to positionally restrain the upper and lower operating handles when in their closed condition.

Further aspects and advantages of this invention will become more clear after careful consideration is give to the following detailed description of the preferred exemplary embodiments thereof.

BRIEF DESCRIPTION OF THE ACCOMPANYING DRAWINGS

Reference will hereinafter be made to the accompanying drawings wherein like reference numerals throughout the various FIGURES denote like structural elements, and wherein;

FIG. 5 is a partial side elevational view of an alternative embodiment of a locking wrench according to the present invention;

FIG. 6 is a cross-sectional elevational view of the wrench shown in FIG. 5 as taken along line 6—6 therein;

FIG. 7 is an end elevational view of another embodiment of a locking wrench according to the present invention;

FIG. 8 is a partial side elevational view of an alternative embodiment of a locking wrench according to the present invention; and FIG. 9 is a cross-sectional elevational view of the wrench shown in FIG. 8 as taken along line 9—9 therein.

DETAILED DESCRIPTION OF THE DRAWINGS

Figure 1:
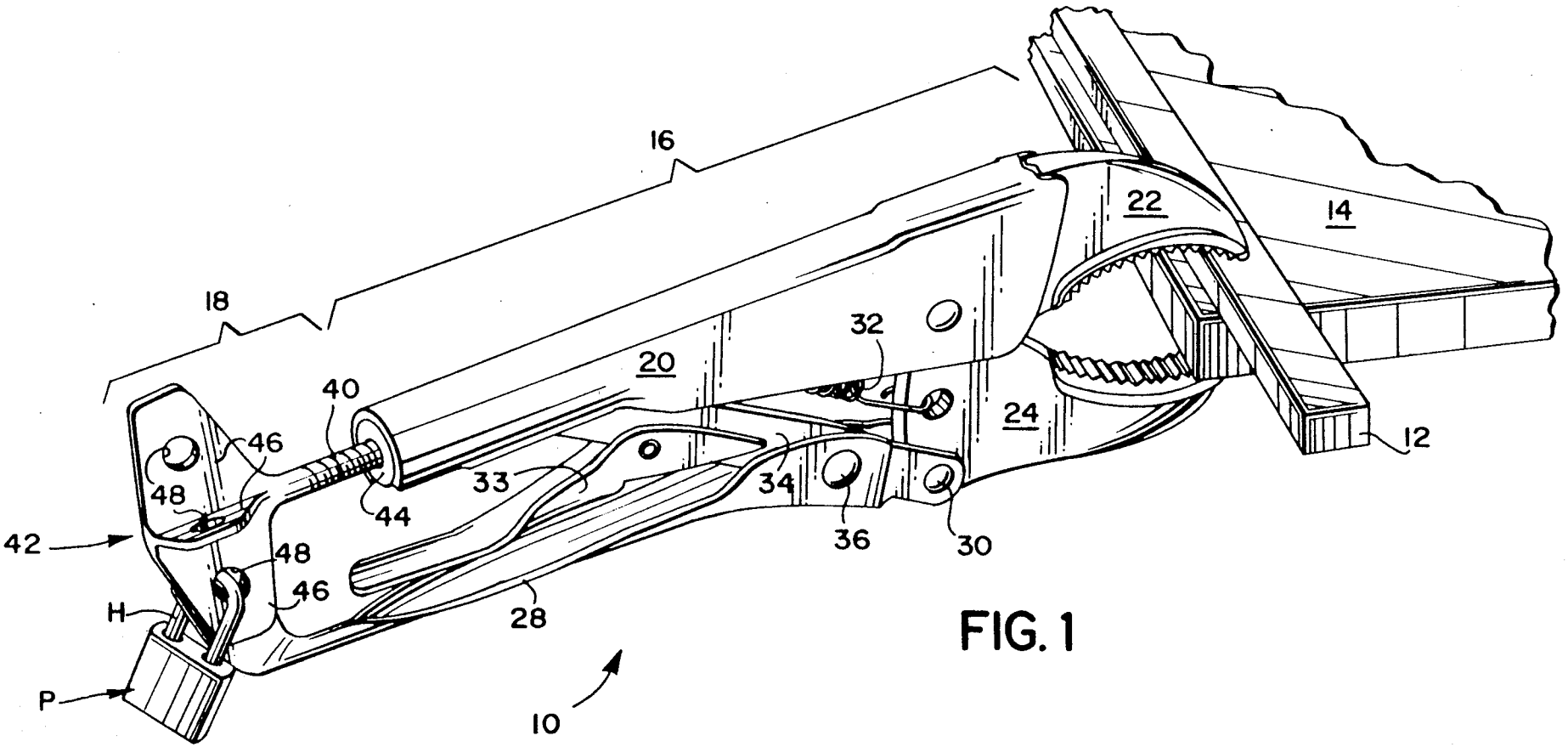
FIG. 1 is a perspective view of the novel locking pliers according to this invention and shown being exemplary used to clamp bar stock to a work surface.

Accompanying FIG. 1 shows a locking wrench 10 according to the present invention in an exemplary use environment to clamp a piece of bar stock 12 to a work surface 14. The wrench 10 is generally comprised of a forward locking wrench subassembly 16 (which in and of itself is conventional) and a rearward handle-restraining subassembly 18 (which incorporates the modifications according to the present invention).

Figure 2:
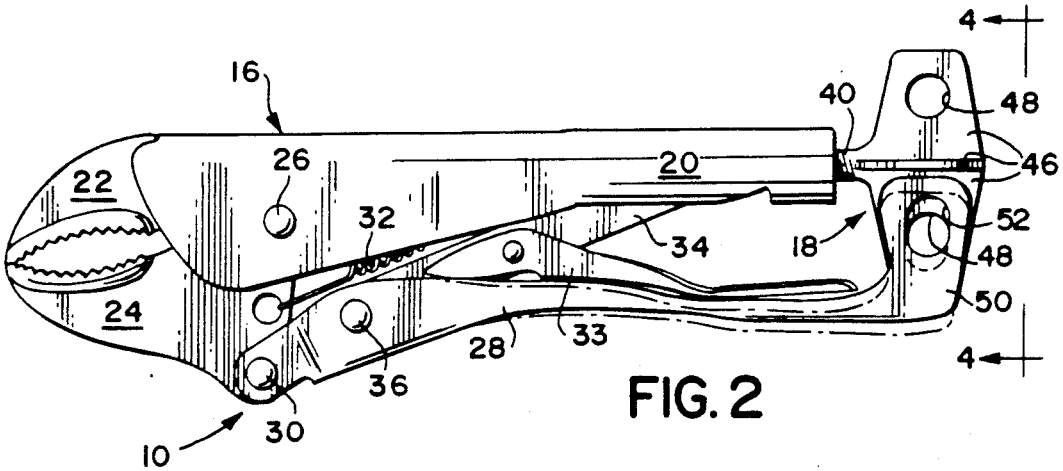
FIG. 2 is a side elevational view of the locking wrench according to the present invention and depicted with the operating handles in a closed condition.
Figure 3:
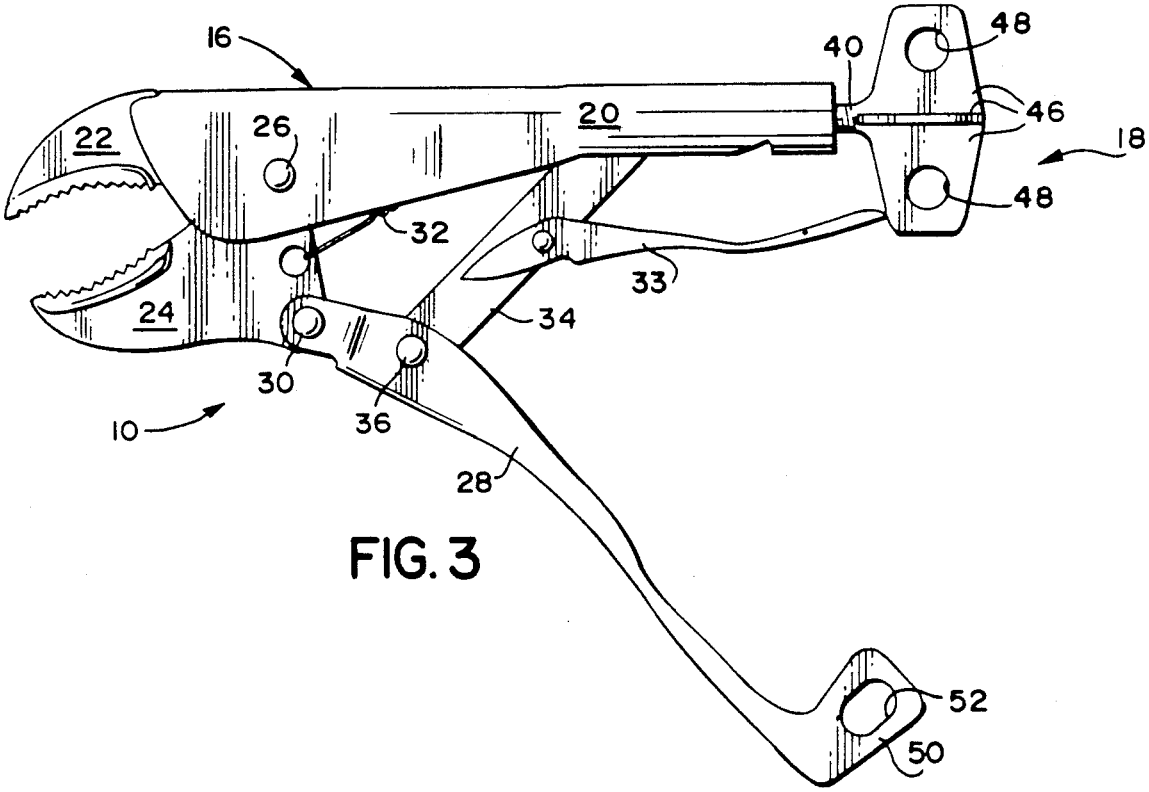
FIG. 3 is a side elevational view of the locking wrench according to the present invention similar to FIG. 2, but shown with the operating handles in an open condition.
Figure 4:
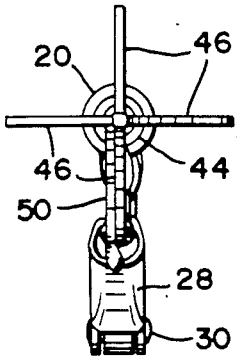
FIG. 4 is an end elevational view of the locking wrench of this invention as taken along line 4—4 in FIG. 2.

As is perhaps more clearly shown in FIGS. 2–4, the locking wrench subassembly 16 includes an upper handle 20 having an upper jaw 22 rigidly fixed to the upper handle 20 at the latter's forward end. A lower jaw 24 is opposed to the upper jaw 22 and is pivotally connected to the upper handle 20 via pivot pin 26. A distal end of the lower operating handle 28 is connected pivotally to the lower jaw 24 at pin 30. Movements of the lower operating handle 28 between its closed condition (i.e., as shown in FIG. 2) and its opened condition (i.e., as shown in FIG. 3) will thereby responsively cause the lower jaw 24 to pivot between respective positions that are closer to and farther from the upper jaw 22.

A tension spring 32 operating between the upper handle 20 and the lower jaw 24 encourages the latter to pivot about pin 26 in a direction which separates the upper and lower jaws 22, 24, respectively (i.e., in a counterclockwise direction as viewed in FIGS. 2 and 3). Optionally, a release lever 33 may be provided so as to facilitate release of the clamping force between jaws 22 and 24—that is, to facilitate movement of the operating handle 28 from its closed condition to its opened condition.

A toggle lever 34 extends between the upper handle 20 and the lower operating handle 28. The toggle lever 34 is pivotally connected at one of its ends to the lower operating handle 28 at a pivot pin 36 rearwardly of the pivot pin 30 and is axially slidably received within the upper handle 20 by suitable means (not shown) at the other of its ends.

The threaded shank 40 of adjustment screw 42 is coupled operatively to the threaded sleeve 44 (see FIGS. 1 and 4) which axial extends within the rearward end of the upper handle 20. As is well known in this art, the terminal end of the threaded shank 18 will coact with the toggle lever 34 so as to in turn allow the operator to select the clamping force exerted between the upper and lower jaws 22, 24, respectively (i.e., in dependance upon the direction of turning movements applied to the adjustment screw 42).

The improvements according to the present invention are essentially embodied in the handle-restraining subassembly 18. In this regard, the adjustment screw 42 is preferably provided with opposing pairs of radially extending wings 46, each of which preferably defines an opening 48.

The proximal end of the operating handle 28 is provided with a flange extension 50 which defines an aperture 52 therethrough. As can be seen particularly in FIG. 2, the flange 50 moves into adjacent relationship to one of the radially extending wings 46 when the lower handle member 28 is forcibly moved into its closed condition. The aperture 52 defined in the flange extension 50 and the opening 48 defined in that one wing 46 which is adjacent to the flange extension will thereby be aligned to allow a restraining element, for example the hasp H of a conventional padlock P, to pass therethrough and thereby positionally retain the lower handle member in its closed condition. In this manner, the clamping force exerted by the upper and lower jaws 22, 24, respectively, will be maintained. Use of the padlock P as the restraining element will also increase security to minimize theft of objects upon which the wrench 10 is clamped.

The lower operating handle 28 usually will have some "play" (as depicted by the chain line representation thereof in FIG. 2) present due to the manner in which the toggle lever 34 and tension spring 32 functionally cooperate. That is, since the tension spring 32 and toggle lever 34 in essence collectively serve as an "over-the-center" assembly, the operating handle 28 will typically be allowed some minor range of opening movement before the clamping force of the jaws 22, 24 is released (i.e., before the force alignment imparted by the tension spring 32 is "over-the-center" of the toggle lever 34). The aperture 52 of the extension flange is thus preferably upwardly elongated (i.e., relative to the upper handle 20) so as to accommodate the "play" that is typically present with the lower operating handle 28.

The restraining element is not necessarily required to effect an absolute rigid union between the upper and lower handles 20, 28, respectively. In other words, since the lower operating handle 28 will usually exhibit some "play" before the clamping force between the jaws 22, 24 is released, it is only important according to the present invention that relative movements between the upper and lower handles 20, 28, respectively, be restrained to the extent of such "play". Because of this, flexible restraining elements such as wire, rope, cable rovings, chain or the like may be used to positionally restrain the upper and lower handle members 20, 28, respectively relative to one another. In other words, according to the present invention, positional handle restraint may be achieved by passing a length of a flexible restraining element through an aligned opening 48 and aperture 52 and then tying or twisting the ends of the flexible element to one another.

As will be understood from the discussion above, therefore, rigid restraining elements other than the padlock hasp H shown in the accompanying drawings could likewise be employed. Thus, for example, rigid bolts, pins, rods, tubing, and the like may be used as the restraining elements according to the present invention.

Although two opposing pairs of wings 46 are shown in the accompanying drawings, greater/lesser numbers of wings may be provided as may be deemed necessary. Thus, if greater "fine" adjustment of the clamping force is desired, then a greater number of wings may be provided, and vice versa. In addition, the flange extension need not be upwardly oriented as shown but could be angled (e.g., L-shaped) or provided in any other desired configuration as long as its aperture and an opening defined in one of the wings 46 are capable of being aligned when the lower operating handle 28 in a closed condition.

In addition to providing the means whereby the upper and lower handles 20, 28, respectively, may be positionally restrained when operatively coupled to the extension flange as described previously, the opposing pairs of radially extending wings 46 define levers of sorts which more easily facilitate manual turning movements applied to the adjustment screw 42.

In this regard, conventional locking-type wrenches usually include a knurled knob at the head of the adjustment screw which is extremely difficult (if not impossible) to operate when the jaws are in a clamped condition. However, because of the lever action provided by the radially extending wings 46, the adjustment screw 42 may be relatively easily turned manually by the operator even when the upper and lower jaws 22, 24 are in a clamped condition (i.e., when the lower operating handle 28 is in a closed condition). Thus, novel locking wrenches according to the present invention may simply be provided with at least one opposing pair of wings 46 in the event the handle restraining functions described previously are not deemed necessary.

The adjustment screw 42 with radially extending wings 46 may also be provided to the market as a "retrofit" item as a replacement for the knurled knob adjustment screw conventionally associated with locking wrenches. Hence, the functional attributes mentioned above can be realized by replacing the conventional knurled knob adjustment screw of those locking wrenches currently in the market with the novel "winged" adjustment screw 42 according to the present invention.

An alternative embodiment of the present invention is shown in accompanying FIGS. 5 and 6. As is seen therein, the extension flange 60 is upwardly and forwardly bent (e.g., generally C-shaped) so as to terminate in an essentially horizontally disposed tail flange **60*a* which defines an aperture 60*b* and is spaced above the lower operating handle 28 by means of upright flange portion 60*c*. The adjustment screw 62 includes a threaded shank portion 62*a* which is threadably coupled to the upper handle 20, and a knurled cylindrical head portion 62*b*. The knurled head portion 62*b* preferably defines a pair of mutually intersecting axially elongate openings 62*c*, 62*d*. A single one of the openings 62*c*, 62*d* or more than a pair of openings 62*c*, 62*d*** may be provided, if desired.

As is perhaps more clearly shown in FIG. 6, the uppermost surface **60*d* of the tail flange 60*a* is concave so as to generally conform to the arcuate external surface of the adjustment screw's head portion 62*b*. In this manner, the tail flange 60*a* and the aperture 60*b* defined thereby may be brought into closely adjacent relationship with the external cylindrical surface of the head portion 62*b* of adjustment screw 62 when the lower operating handle 28 is in its closed state. Thus, one of the openings 62*c*, 62*d* defined by the head portion 62*b* will be capable of being brought into registry with the aperture 60*b*** so that a restraining element may be passed therethrough in a manner similar to that described previously.

Accompanying FIG. 7 shows one possible modification to the embodiment described above in FIGS. 5–6. In this connection, it will be noted that the head portion **62*b*' of the adjustment screw 62' similarly defines a pair of mutually intersecting apertures 62*c*' and 62*d*' which open onto the valleys between adjacent respective ones of raised longitudinally extending lobes 62*e*'. The lobes 62*e*' serve to facilitate manipulation of the adjustment screw 62'** by the user.

The tail flange **60*a*' of the extension flange 60' defines an aperture 60*b*' therethrough which is adapted to being brought into adjacent registry with one of the openings 62*c*', 62*d*' in a manner similar to that described above in connection with the embodiment shown in FIGS. 5 and 6. It will be observed, however, that the uppermost surface 60*d*' of the tail flange 60*b*' is convexly curved so as to closely match the concave curvature in the valley regions between adjacent lobes 62*e*'. Thus, the tail flange 60*b*' is able to be brought into closely adjacent relationship to the exterior surface in the valley regions between adjacent lobes 62*e*' when the upper and lower handles 20, 28 are in a closed condition so that the aperture 60*b*' and one of the openings 62*c*', 62*d*' may be aligned with one another. It will be appreciated that the cooperation between the convex surface 60*c*' of the tail flange 60*a*' and the valley regions between adjacent lobes 62*e*' will furthermore serve to impede turning movements being applied to the adjustment screw 62' when the handles 20, 28** are in a closed condition.

Accompanying FIGS. 8 and 9 show a further embodiment of a wrench according to the present invention as including an extension flange 70 rearwardly extending from the lower handle 28 and defining a longitudinally oriented slot 72. The adjustment screw 74 includes a threaded shank portion 74*a* which, like the other embodiments described above, is adapted to being threadably coupled axially to the upper handle 20. The adjustment screw 74 also includes a knurled cylindrical knob portion 74*b* and a rearwardly projecting planar key flange 74*c* which defines an opening 74*d* therethrough.

An rigid restraining element 76 in the form of an elongate loop includes a transverse lower leg 76*a* that extends through the slot 72 of the extension flange 70 and thereby allows the restraining element 76 to be slidably moved in the longitudinal directions established by the slot 72. An intermediate leg 76*b* establishes an elongate opening 76*c* collectively with the upper leg 76*d* of the restraining element 76 which is sized and configured to allow the planar key flange 74*c* to pass therethrough when the restraining element 76 is pivoted into cooperative engagement with the adjustment screw 74.

It will be noted that the upper and lower handle members 20, 28, respectively will be positionally restrained relative to one another when the key flange 74*c* and restraining element 76 are cooperatively engaged with one another as shown in FIGS. 8 and 9. However, there exists the possibility of disengagement of the key flange 74*c* and restraining element 76. To prevent such disengagement, it is preferred that a supplemental rigid or flexible restraining element (not shown, but of the variety as described above) be passed through the opening 74*d* of the key flange 74*c* when restraining element 76 is cooperatively engaged therewith. In this manner, the restraining element 76 will be captured between the supplemental restraining element and the cylindrical knurled knob 74*b* of the adjustment screw 74 which precludes the restraining element 76 from pivoting out of engagement with the key flange 74*c*.

It is entirely conceivable that a restraining element could be provided as an accessory element for the wrenches of the present invention when sold commercially. And, the restraining element could be provided as an integral part of the wrench, for example, by physically attaching a restraining element to the upper or lower handles 20, 28, respectively, via flexible chain, cord or the like, or via suitable hinge structures so that a restraining element is always available to the operator when the wrench is in use.

While a conventional pair of jaws associated with the locking wrenches of this invention has been shown in the accompanying drawings, they are simply representative of any opposing movable members that may be acted upon using a toggle lever according to the general principles of locking-type wrenches. Thus, the term "jaws" as used herein and in the accompanying claims should be interpreted broadly to include any opposing structural member which is otherwise associated with a locking-type wrench of the variety described previously.

Therefore, while the present invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A locking wrench comprising:

a stationary upper handle which includes a fixed upper jaw, and a lower jaw pivotally connected to said upper handle so that said lower jaw is in opposition to and pivotally movable towards and away from said upper jaw;

a lower operating handle having a distal end pivotally connected to said lower jaw and movable between closed and opened positions which responsively pivotally moves said lower jaw towards and away from said upper jaw;

a toggle lever pivotally coupled at one end to said lower operating handle and having an opposite end coupled operatively to said upper handle;

screw adjustment means having a head portion and a threaded shank portion threadably engaged with said upper handle and operatively coacting with the opposite end of said toggle lever for effecting clamping force adjustment between said upper and lower jaws, and restraining means for positionally restraining said upper and lower handles relative to one another to thereby maintain said clamping force between said upper and lower jaws, said restraining means including:

(a) a flange extension which rearwardly projects from said lower operating handle and which defines an aperture therethrough, and (b) an opening defined in the head portion of said screw adjustment means, wherein said aperture and opening are brought into cooperative adjacent relationship with one another when said lower operating handle is moved into said closed position.

2. A locking wrench as in claim 1, wherein;

said screw adjustment means includes at least one pair of radially extending wings each defining a respective said opening;

said extension flange includes an upright flange member defining said aperture; and wherein one of said wings and said upright flange member are brought into cooperative adjacent relationship relative to one another when said lower handle is in said closed position such that said opening defined by said one wing and said aperture defined by said upright flange are in registry with one another so as to allow a restraining element to extend therethrough and thereby positionally restrain said upper and lower handles relative to one another, whereby said clamping force between said upper and lower jaws is maintained.

3. A locking wrench as in claim 2, wherein said at least one pair of wings radially extend from said screw adjustment means in opposite directions.

4. A locking wrench as in claim 2, wherein multiple opposing pairs of wings radially extend from said screw adjustment means, and wherein respective selected ones of said wings define said openings.

5. A locking wrench as in claim 2, wherein said aperture defined in said upright flange is elongated.

6. A locking wrench as in claim 1, wherein;

said head portion of said adjustment screw has a generally cylindrical exterior surface; and wherein said extension flange includes a concave surface that closely matches the cylindrical exterior surface of said head portion so that said defined aperture and opening may be brought into closely adjacent registry with one another when said lower operating handle is in said closed position.

7. A locking wrench as in claim 1, wherein;
said head portion includes a number of longitudinal lobes which establish longitudinal surface valleys between adjacent ones of said lobes; and wherein
said extension flange includes a convex surface that closely matches the surface valleys of said head portion so that said defined aperture and opening may be brought into closely adjacent registry with one another when said lower operating handle is in said closed position.

8. A locking wrench as in claim 7, wherein said head portion defines a pair of mutually intersecting openings having ends terminating at a respective one of said surface valleys.

9. A locking wrench as in claim 6 or 7, wherein said head portion defines a pair of mutually intersecting openings.

10. A locking wrench as in claim 6 or 7, wherein said extension flange includes a tail flange portion which is vertically spaced relative to said operating handle.

11. A locking wrench as in claim 1, wherein;
said head portion of said adjustment screw includes a key flange which defines said opening, and
said extension flange defines a longitudinally elongate slot, and wherein
the locking wrench further comprises a restraining element having one end coupled to said slot for reciprocal longitudinal movements therewithin, and another end which defines said aperture and is sized and configured to accept said key flange of said adjustment screw therein.

12. A locking wrench comprising:
an upper handle having a threaded sleeve at a rearward end thereof, and an upper jaw rigidly connected to a forward end thereof;
a lower jaw pivotally connected to said upper handle in opposition to said upper jaw;
a lower operating handle having a forward section pivotally connected to said lower jaw for pivotally moving said lower jaw between clamped and unclamped positions relative to said upper jaw;
a toggle lever pivotally connected at one end to said lower operating handle rearwardly of said forward section that is pivotally connected to said lower jaw, and having another end which is axially slidably received within said upper handle;
an adjustment screw having a head portion and a threaded shank that is threadably coupled to said threaded sleeve of said upper handle for acting upon said another end of said toggle lever to axially slidably move said toggle lever within said upper handle whereby clamping force between said upper and lower jaws is adjusted;
an extension member extending rearwardly from said lower operating handle and defining an aperture therethrough; and
an opening defined in said head portion of said adjustment screw so as to be registerable with said defined aperture in said extension member when said lower operating handle moves said lower jaw into said clamped position thereof.

13. A locking wrench as in claim 12, further comprising a restraining element cooperatively associated with said defined opening and said aperture for positionally restraining said upper and lower handles relative to one another to prevent movement of said lower jaw from said clamped position and into said unclamped position thereof.

14. A locking wrench as in claim 12, wherein said head portion of said adjustment screw includes at least one radially extending wing which defines said opening, and wherein said extension member includes an upright flange which defines said aperture.

15. A locking wrench as in claim 14, wherein said head portion of said adjustment screw includes opposing pairs of radially extending wings each of which defines an opening.

16. A locking wrench as in claim 12, wherein;
said head portion of said adjustment screw has a generally cylindrical exterior surface; and wherein
said extension flange includes a concave surface that closely matches the cylindrical exterior surface of said head portion so that said defined aperture and opening may be brought into closely adjacent registry with one another when said lower operating handle is in said closed position.

17. A locking wrench as in claim 12, wherein;
said head portion includes a number of longitudinal lobes which establish longitudinal surface valleys between adjacent ones of said lobes; and wherein
said extension flange includes a convex surface that closely matches the surface valleys of said head portion so that said defined aperture and opening may be brought into closely adjacent registry with one another when said lower operating handle is in said closed position.

18. A locking wrench as in claim 17, wherein said head portion defines a pair of mutually intersecting openings having ends terminating at a respective one of said surface valleys.

19. A locking wrench as in claim 16 or 17, wherein said head portion defines a pair of mutually intersecting openings.

20. A locking wrench as in claim 16 or 17, wherein said extension flange includes a tail flange portion which is vertically spaced relative to said operating handle.

21. A locking wrench as in claim 12, wherein;
said head portion of said adjustment screw includes a key flange which defines said opening, and said extension flange defines a longitudinally elongate slot; and wherein the improvement further comprises
a restraining element having one end coupled to said slot for reciprocal longitudinal movements therewithin, and another end which defines said aperture sized and configured to accept said key flange of said adjustment screw therein.

22. An improved locking wrench comprising:
an upper handle having a threaded sleeve at a rearward end thereof, and an upper jaw rigidly connected to a forward end thereof;
a lower jaw pivotally connected to said upper handle in opposition to said upper jaw;
a lower operating handle having a forward section pivotally connected to said lower jaw for pivotally moving said lower jaw between clamped and unclamped positions relative to said upper jaw, and a rearward extension flange which defines an aperture;
a toggle lever pivotally connected at one end to said lower operating handle rearwardly of said forward section that is pivotally connected to said lower jaw, and having another end which is axially slidably received within said upper handle;

an adjustment screw having a head and a threaded shank that is threadably coupled to said threaded sleeve of said upper handle for acting upon said another end of said toggle lever to axially slidably move said toggle lever within said upper handle whereby clamping force between said upper and lower jaws is adjusted; wherein (i) said adjustment screw includes at least one pair of radially extending opposing wings to facilitate manual turning movements being applied to said adjustment screw;

(ii) said radially extending wings define respective openings therethrough; and wherein (iii) said extension flange is adapted to being brought into adjacent position with one of said wings when said lower jaw is moved into said clamped position by said lower operating handle such that said opening of said one wing and said aperture of said extension flange are in alignment with one another.

23. An improved locking wrench as in claim 22, further comprising a restraining element sized and configured to pass through said aligned opening and aperture to thereby positionally restrain said upper and lower handles relative to one another.

24. An improved locking wrench as in claim 22, wherein said extension flange extends essentially upwardly from said lower handle toward said upper handle.

25. An improved locking wrench as in claim 22, wherein said aperture is elongated in a selected direction.

26. An improved locking wrench as in claim 25, wherein said aperture is elongated in an upward direction relative to said upper handle.

27. An improved locking wrench as in claim 22, wherein said adjustment screw includes a number of radially extending opposing pairs of wings.

28. An improved locking wrench as in claim 22, further comprising tension spring means operatively positioned between said upper handle and said lower jaw for encouraging said lower jaw to pivot away from said upper jaw.

29. An improved locking wrench as in claim 22, further comprising a release lever cooperatively acting upon said lower handle to facilitate moving said lower jaw into said unclamped position.

30. A locking wrench comprising:

upper and lower handles respectively having opposed upper and lower jaws;

said upper jaw being rigid with a forward end of said upper handle, and a said lower jaw being pivotally connected to a forward end of said lower handle;

said upper and lower handles being operatively coupled to one another so as to be relatively movable between closed and opened states which thereby responsively moves said jaws into clamped and unclamped positions, respectively;

a toggle lever pivotally connected at one end to said lower handle and operatively coupled at an opposite end to said upper handle, an adjustment screw threadably coupled to a rearward end of said upper handle and having a terminal end which cooperates with said opposite end of said toggle lever to thereby allow manual selective adjustment of a clamping force between said upper and lower jaws, and handle-restraining means for positionally restraining said upper and lower handles relative to one another, whereby said manually selected clamping force is maintained, said handle-restraining means includes;

(i) opposing pairs of wings radially extending from said adjustment screw, said wings defining respective openings therethrough; and (ii) an extension flange rigid with a rearward end of said lower handle and defining an aperture therethrough; wherein (iii) one of said wings is adjacent said extension flange when said lower handle is brought into said closed state relative to said upper handle so as to effect alignment between said respective opening of said one wing and said aperture of said extension flange to allow a restraining element to pass therethrough, whereby said lower handle member is prevented from assuming said opened state relative to said upper handle.

31. A locking wrench as in claim 30, wherein said aperture is elongated.

32. A locking wrench as in claim 30, further comprising tension spring means operatively positioned between said upper handle and said lower jaw for encouraging said lower jaw to pivot away from said upper jaw.

33. A locking wrench as in claim 30, further comprising a release lever cooperatively acting upon said lower handle to facilitate moving said lower handle into said opened state relative to said upper handle.

34. A locking wrench comprising:

an upper handle and a lower operating handle;

said upper handle having a fixed upper jaw;

said lower operating handle having a lower jaw movably connected to said lower operating handle and to said fixed upper jaw so as to be in opposition to said upper jaw, wherein movements of said lower operating handle between open and closed states relative to said upper handle causes said lower jaw to be moved relative to said opposing upper jaw between clamped and unclamped conditions, respectively;

a toggle lever coupled operatively at one end to said lower operating handle and at another end to said upper handle;

an adjustment screw threadably coupled to said upper handle for threaded reciprocal movements between greater and lesser axial positions relative to said upper handle and acting upon said toggle lever to effect selective adjustment of a clamping force exerted by means of said upper and lower jaws; and a handle-restraining system which includes first and second restraining elements respectively forming a part of said lower operating handle and said adjustment screw, said second restraining element being fixed to said adjustment screw for concurrent movements therewith between said greater and lesser axial positions, said first and second restraining elements being brought into cooperative aligned relationship with one another when said lower operating handle is moved into said closed state thereof so as to responsively move said lower jaw into said clamped condition, whereby said lower operating handle may be restrained from moving into said opened state thereof.

35. A locking wrench as in claim 34, wherein said first restraining element includes a flange extension forming a rigid part of said lower operating handle.

36. A locking wrench as in claim 35, wherein said flange extension extends parallel to said adjustment screw.

37. A locking wrench as in claim 35, wherein said flange extension defines an aperture, and wherein said second restraining element includes a knob at an end of said adjustment screw which defines an opening which is registerable with said defined aperture when said lower operating handle is moved into said closed state thereof.

38. A locking wrench as in claim 35, wherein said flange extension defines an aperture, and wherein said second restraining element includes a pair of opposing wings at an end of said adjustment screw, each of said wings defining openings therethrough, said extension flange being moved into adjacent relationship with one of said wings when said lower operating handle is moved into said closed state so that said aperture and said opening of said one wing are in registry with one another.

39. A locking wrench as in claim 35, wherein said flange extension defines an elongate aperture, and includes a restraining loop movably coupled within said aperture, and wherein said second restraining element includes a key flange forming a part of said adjustment screw, wherein said restraining loop may be moved into coupling relationship with said key flange when said lower operating handle is moved into said closed state thereof.

40. A locking wrench comprising:

an upper handle and a lower operating handle;

said upper handle having a fixed upper jaw;

said lower operating handle having a lower jaw movably connected to said lower operating handle and to said fixed upper jaw so as to be in opposition to said upper jaw, wherein movement of said lower operating handle between open and closed states relative to said upper handle causes said lower jaw to be moved relative to said opposing upper jaw between clamped and unclamped conditions, respectively;

a toggle lever coupled operatively at one end to said lower operating handle and at another end to said upper handle;

an adjustment screw threadably coupled to said upper handle for threaded reciprocal movements between greater and lesser axial positions relative to said upper handle and acting upon said toggle lever to effect selective adjustment of a clamping force exerted by means of said upper and lower jaws;

a spring which exerts a force upon said lower jaw tending to move said lower jaw towards said unclamped condition; and a handle-restraining system which includes (i) a first restraining element forming a part of said lower operating handle; and (ii) a second restraining element forming an integral fixed part of said adjustment screw to thereby be movable concurrently with said adjustment screw between said greater and lesser axial positions; whereby (iii) said first and second elements are aligned, and thereby capable of being coupled one to another, when said lower operating handle is moved into said closed state thereof, and said lower operating handle may be restrained from moving into said opened state thereof.

41. A locking wrench as in claim 40, wherein said first restraining elements includes a restraining loop movably connected to said lower operating handle, and wherein said second restraining element includes a flange forming a part of said adjustment screw and adapted to being cooperatively engaged with said restraining loop.

42. A locking wrench as in claim 41, wherein said flange includes an opening.

43. A locking wrench as in claim 42, further comprising a supplemental restraining element adapted to being passed through said opening in said flange and thereby capture said restraining loop.

* * * * *